United States Patent [19]

Wolters et al.

[11] Patent Number: 5,056,470

[45] Date of Patent: Oct. 15, 1991

[54] PISTON-OPERATED INTERNAL-COMBUSTION ENGINE HAVING WET CYLINDER LINERS

[75] Inventors: Gerd-Michael Wolters, Immenstaad; Otto Reifenscheid, Friedrichshafen; Michael Groddeck, Meckenbeuren, all of Fed. Rep. of Germany

[73] Assignee: S. Soga & Co.

[21] Appl. No.: 423,413

[22] PCT Filed: Jan. 17, 1989

[86] PCT No.: PCT/DE89/00019

§ 371 Date: Aug. 15, 1990

§ 102(e) Date: Aug. 15, 1990

[87] PCT Pub. No.: WO89/07710

PCT Pub. Date: Aug. 24, 1989

[30] Foreign Application Priority Data

Feb. 9, 1988 [DE] Fed. Rep. of Germany ..... 3803890

[51] Int. Cl.[5] ..... F02F 1/10

[52] U.S. Cl. ..... 123/41.84; 123/193 CP

[58] Field of Search ..... 123/41.83, 41.84, 193 CP

[56] References Cited

U.S. PATENT DOCUMENTS

| | | | |
|---|---|---|---|
| 3,785,357 | 1/1974 | Okazaki | 123/195 R |
| 3,786,796 | 1/1974 | Okazaki | 123/195 R |
| 3,973,547 | 8/1976 | Weiss | 123/41.83 |

OTHER PUBLICATIONS

Russian Publication Diesel Generator IA-9 DG, pgs. 244–246, 580, 582 and figures 2 and 10; Aug. 10, 1987.

*Primary Examiner*—Noah P. Kamen

*Attorney, Agent, or Firm*—Barnes & Thornburg

[57] ABSTRACT

For the mounting and servicing of a piston-operated internal-combustion engine, devices for the highly loadable fastening of an auxiliary mounting tool are developed at the cylinder lining 11 and the piston 23. This facilitates the mounting and dismounting of the cylinder liner 11 and the pertaining piston/connecting rod assembly as a unit.

3 Claims, 1 Drawing Sheet

36
21
13
11
14
22
12
20

35
34
37
32
33
II
30
27
26
13
20
21
28
19
22
12
29
31
23
14
17
15
11
24
16
18
25

PISTON-OPERATED INTERNAL-COMBUSTION ENGINE HAVING WET CYLINDER LINERS

BACKGROUND AND SUMMARY OF THE INVENTION

The invention relates to a piston-operated internal-combustion engine having wet cylinder liners whose collars are each arranged in the cylinder block and crankcase in a sunk manner, the bearing eye of the connecting rod pertaining to each cylinder on the side of the crankshaft being wider than the inside diameter of the cylinder liner, and the piston / connecting rod assembly which is assigned to each cylinder being mountable and dismountable only together with the pertaining cylinder inner as a unit. The invention has the purpose of facilitating the mounting and servicing of a piston-operated internal-combustion engine, whose cylinder liners are installed with an interference fit in the cylinder block and crankcase.

A piston-operated internal-combustion engine of this type is known from EP 0 140 894 B1. The mounting and dismounting of a unit consisting of the cylinder liner and a piston / connecting rod assembly take place by means of a radially expandable tool which is inserted into the cylinder bore. The axial force for the tearing-off of a cylinder liner required for the dismounting is to be transmitted to the cylinder liner by means of the frictional engagement between the tool and the cylinder bore. The radial force required for the frictional engagement is generated by the expanding of the tool. However, the radial force causes an expanding of the thin-walled cylinder liner in the area of the tool. In this manner, the cylinder liner, by means of the expanded tool, also is braced with respect to the cylinder block and crankcase. The axial force which is required for the dismounting of a cylinder liner installed with an interference fit and which is very large anyhow continues to increase undesirably and makes a dismounting by means of the devices of the known arrangement impossible.

When a unit is demounted, a part of the force for the tearing-off of the cylinder liner is to be generated by moving the piston against the tool. The force exercised by the piston on the tool braces itself against the cylinder block and crankcase by means of different engine components, such as the pin bearings, the connecting rod bearings and the crankshaft bearings. The concerned engine components are very sensitive to static loads so that it cannot be excluded that unnoticed damage occurs during the dismounting of a unit.

During the mounting of a unit, the piston / connecting rod assembly is to be held in position with respect to the cylinder liner by means of a partial vacuum between the tool and the piston. The tightness, which can be achieved by means of the piston rings of the piston, however, is insufficient for maintaining a sufficient vacuum over the duration of the mounting. Relative movements between the cylinder liner and the piston / connecting rod assembly during the mounting cannot be excluded and may result in unnoticed damage to engine parts, which would lead to their premature failure.

It is therefore an object of the invention to provide, for a piston-operated internal-combustion engine of this type having wet cylinder liners and whose piston / connecting rod assemblies can be mounted as a unit only together with the pertaining cylinder liners, a configuration of components by means of which the mounting of the units is simplified and safer, the dismounting of each unit is facilitated, and a damaging static loading of engine parts during the dismounting of a unit is avoided.

According to the invention, this object is achieved by providing an arrangement characterized in that, at the end of the collar of each cylinder liner on the cylinder head side, an external thread is arranged which is concentric with respect t to the collar, that the external thread, with respect to the outer diameter of the collar of the cylinder liner has a smaller outer diameter while forming a plane surface which points to the cylinder head, and in that each piston has a device arranged in the piston head for the application of a load lifting device.

Preferred embodiments of the invention are characterized by the following features:

i that the device for the application of a load-lifting device consists of at least two enlarged sections which, at the edge of a combustion chamber recess of the piston, project radially toward the inside; and ii the device for the application of a load lifting device consists of at least one threaded blink hole arranged axially in the piston head.

The advantages achieved by means of the invention are, in particular, that a highly loadable mechanical connection can be established between a mounting arrangement and the cylinder liner, that a deforming of the cylinder liner through the use of the mounting arrangement is excluded, that, during the dismounting of a unit, no static loading of engine components takes place, and that, during the mounting or dismounting, a reliable and stable connection exists between the mounting arrangement and all parts of a unit.

An embodiment of the invention is shown in the drawing and will be described in detail in the following.

DETAILED DESCRIPTION OF THE DRAWINGS

Figures 1, 2:
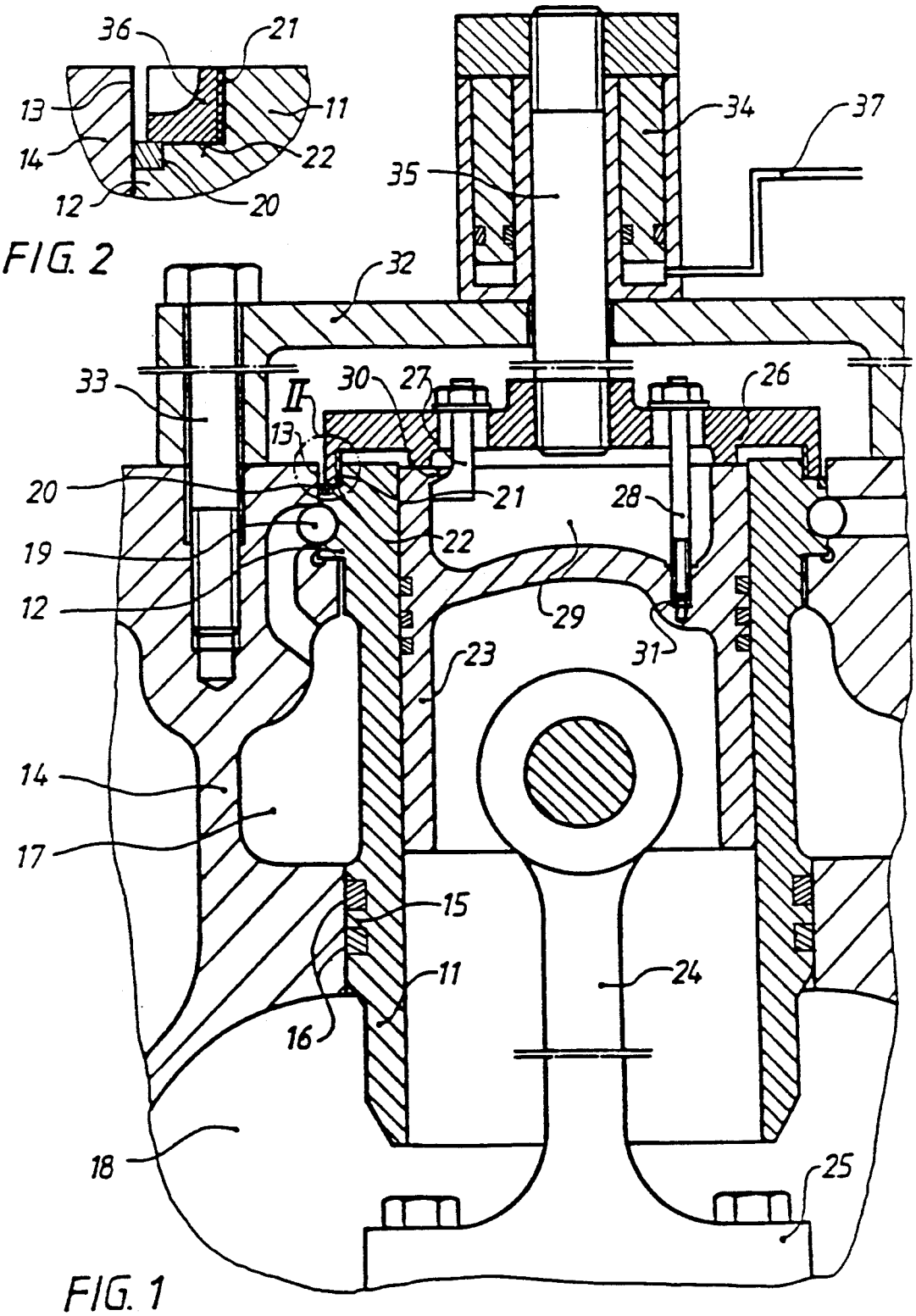
FIG. 1 is a cross-sectional view of a cylinder in the demounted condition.
FIG. 2 is a view of a detail according to Line II in FIG. 1 at the collar of the cylinder liner in the completely mounted condition.

Each cylinder of a piston-operated internal-combustion engine, which is not shown in detail, is lined with a wet cylinder liner 11, whose collar 12 is arranged, in a sunk manner, in a cylindrical recess 13 of the cylinder block and crankcase 14. By means of cylindrical fits between the collar 12 and the recess 13 as well as between a shoulder 15 of the cylinder liner 11 and the cylinder block and crankcase 14, a centric interference fit is ensured of the cylinder liner 11 in the cylinder block and crankcase 14. For the sealing-off of the cooling-water space 17 with respect to the crank space 18, elastic sealing rings 16 are arranged in the shoulder 15. A cooling-water annulus 19 developed at the collar 12 of the cylinder liner 11, by means of a sealing ring 20, is sealed off with respect to the end of the recess 13 on the cylinder head side.

At the end of the collar 12 of the cylinder liner 11 on the side of the cylinder head, an external thread 21 is arrange which is concentric with respect to the collar 12. The external thread 21 has an outer diameter which is smaller than the outer diameter of the collar 12, whereby a plane surface 22 is formed which points to the cylinder head.

In the completely mounted condition of the piston-operated internal-combustion engine (FIG. 2), a threaded ring 36, which will then form a missing groove flank for the sealing ring 20, is screwed onto the external thread 21 at the collar 12 of the cylinder liner 11.

A piston / connecting rod assembly consisting of a piston 23 and a connecting rod 24 is assigned to each cylinder of the piston-operated internal-combustion engine. The bearing eye 25 of the connecting rod 24 on the crankshaft side has a larger width than the inside diameter of the cylinder liner 11. The conventional mounting, in which the connecting rod 24, with the bearing eye 25 on the crankshaft side first, is pushed through the cylinder liner 11 which had already been inserted in the cylinder block and crankcase 14, cannot be carried out in this case. For this reason, the piston / connecting-rod assembly, which is assigned to each cylinder, can be mounted and demounted only as a unit together with the pertaining cylinder liner 11.

Symmetrically arranged devices for the application of a load lifting device are developed at the piston 23 which may have a combustion chamber recess 29. These symmetrically arranged devices may consist of at least two enlarged sections 30 projecting, at the edge of the combustion chamber recess 29, radially toward the inside, or of one or two threaded blind holes 31 which are axially arranged in the piston head.

For the mounting and dismounting of a unit consisting of the cylinder liner 12, the piston 23 and the connecting rod 24, a special mounting arrangement is required which ensures the holding-together of the components in one unit and ensures the secure manipulation of the unit during the whole mounting operation.

The mounting arrangement consists of a bell-shaped plate 26 which is screwed onto the external thread 21 of the cylinder liner 11 and is braced against the plane surface 22, as well as of a pair of grippers 27 or a pair of tightening screws 28 which interact with the devices for the application of a load lifting device developed at the piston 23. By means of the joining of the mounting arrangement, the cylinder liner 11 and the piston / connecting rod assembly are firmly connected with one another into a unit. In order to prevent a swinging of the connecting rod 24 during the mounting, spacers (not shown) are fitted onto the connecting rod 24 and brace themselves against the cylinder liner 11.

When the piston-operated internal-combustion engine is assembled, the unit, which is held together by the mounting arrangement, is inserted into the bore of the cylinder block and crankcase 14 up to the start of the spouting of the fit. The pressing-in of the unit, until the collar 12 rests on the base of the recess 13, takes place by means of a pressing-in arrangement which is connected with the mounting arrangement and is fastened to the cylinder block and crankcase 14. After the tool is disconnected and removed, the piston 23 can be moved downward in the cylinder liner 11 and the connecting rod 24 can be connected with the crankshaft.

The dismounting of a unit takes place essentially in reverse of the sequence of the above-described manipulations. First, the external thread 21 must be exposed by removing the threaded ring 36, so that the bell-shaped plate 26 can be screwed on the cylinder liner 11. Then, after the connecting rod is separated from the crankshaft, the cylinder liner 11 and the connecting rod assembly are connected with the plate 26 to form the unit. The force for the detaching of the cylinder liner 11 from the cylinder block and crankcase 14 is generated by a pressing-out arrangement. The pressing-out arrangement consists of a traverse 32 which, by means of screws 33, is fastened to the cylinder block and crankcase 14 and of a hydraulic cylinder 34 with a pressure oil feeding device 37. The hydraulic cylinder 34 is connected with the bell-shaped plate 26 by means of a tie rod 35.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A piston-operated internal-combustion engine having wet cylinder liners, whose collars are each arranged in the cylinder block and crankcase in a sunk manner, the bearing eye of the connecting rod pertaining to each cylinder on the side of the crankshaft being wider than the inside diameter of the cylinder liner, and the piston / connecting rod assembly which is assigned to each cylinder being mountable and dismountable only together with the pertaining cylinder liner as a unit, characterized in that, at the end of the collar of each cylinder liner on the cylinder head side, an external thread is arranged which is concentric with respect to the collar, that the external thread, with respect to the outer diameter of the collar of the cylinder liner has a smaller outer diameter while forming a plane surface which points to the cylinder head, and in that each piston has a device arranged in the piston head for the application of a load lifting device.

2. A piston-operated internal-combustion engine according to claim 1, where characterized in that the device for the application of a load-lifting device consists of at least two enlarged sections which, at the edge of a combustion chamber recess of the piston, project radially toward the inside.

3. A piston-operated internal-combustion engine according to claim 1, characterized in that the device for the application of a load lifting device consists of at least one threaded blink hole arranged axially in the piston head.

* * * * *